US009418606B2

(12) United States Patent
You et al.

(10) Patent No.: US 9,418,606 B2
(45) Date of Patent: Aug. 16, 2016

(54) GATE DRIVING CIRCUIT OF DISPLAY PANEL AND DISPLAY SCREEN WITH THE SAME

(71) Applicant: Shanghai Tianma Micro-Electronics Co., Ltd., Shanghai (CN)

(72) Inventors: Shuai You, Shanghai (CN); Hong Li, Shanghai (CN); Jun Ma, Shanghai (CN)

(73) Assignee: Shanghai Tianma Micro-Electronics Co., Ltd., Shanghai (CN)

( * ) Notice: Subject to any disclaimer, the term of this patent is extended or adjusted under 35 U.S.C. 154(b) by 402 days.

(21) Appl. No.: 13/936,082

(22) Filed: Jul. 5, 2013

(65) Prior Publication Data

US 2013/0293529 A1 Nov. 7, 2013

Related U.S. Application Data

(63) Continuation of application No. PCT/CN2012/078236, filed on Jul. 5, 2012.

(30) Foreign Application Priority Data

Nov. 22, 2011 (CN) ..... 2011 1 0373342

(51) Int. Cl.
*G09G 3/36* (2006.01)
*G09G 3/20* (2006.01)

(52) U.S. Cl.
CPC ..... *G09G 3/3611* (2013.01); *G09G 3/20* (2013.01); *G09G 2310/0267* (2013.01);
(Continued)

(58) Field of Classification Search
CPC ..... G09G 2310/0286; G09G 3/3266; G09G 3/3614; G09G 2320/0242; G09G 2320/0247; G09G 2320/0266; G09G 2310/0235; G09G 2320/0204; G11C 19/184
See application file for complete search history.

(56) References Cited

U.S. PATENT DOCUMENTS

2004/0070590 A1* 4/2004 Lee ..... G09G 3/2022 345/690
2004/0189583 A1* 9/2004 Park ..... G09G 3/3677 345/100

(Continued)

FOREIGN PATENT DOCUMENTS

CN 101013566 A 8/2007
CN 101046940 A 10/2007

(Continued)

OTHER PUBLICATIONS

Notice of Allowance for Korean Patent Application No. 1020137011977, mailed on Nov. 24, 2014, 6 pages total.

(Continued)

*Primary Examiner* — Andrew Sasinowski
*Assistant Examiner* — Chun-Nan Lin
(74) *Attorney, Agent, or Firm* — Alston & Bird LLP

(57) ABSTRACT

A gate driving circuit drives a plurality of gate lines arranged in a display panel. The gate driving circuit includes a shift register having at least two stages of shift register units, and a gate enable circuit. Each shift register unit includes a gate signal output terminal configured to output a gate signal. The gate enable circuit includes a plurality of gate enable units. Each gate enable unit corresponds to one of the shift register units and includes an input terminal connected to the gate signal output terminal of the corresponding shift register unit, an output terminal connected to a corresponding one of the gate lines, and an enable signal input terminal configured to receive an enable signal. Each gate enable unit is configured to selectively output the gate signal of the corresponding shift register unit to the corresponding gate line based on the state of the received enable signal.

16 Claims, 8 Drawing Sheets

(52) U.S. Cl.
CPC ..... *G09G 2310/04* (2013.01); *G09G 2310/08* (2013.01); *G09G 2320/103* (2013.01); *G09G 2330/021* (2013.01); *G09G 2340/16* (2013.01)

(56) References Cited

U.S. PATENT DOCUMENTS

| | | | | |
|---|---|---|---|---|
| 2005/0073510 | A1* | 4/2005 | Martin | G09G 3/20 345/204 |
| 2007/0296676 | A1* | 12/2007 | Moon | G09G 3/3677 345/98 |
| 2009/0121993 | A1* | 5/2009 | Masumura | G09G 3/3614 345/88 |
| 2009/0303169 | A1 | 12/2009 | Tanikame et al. | |
| 2010/0156858 | A1* | 6/2010 | Moon | G11C 19/28 345/204 |
| 2010/0231575 | A1 | 9/2010 | Moon et al. | |
| 2011/0242071 | A1 | 10/2011 | Koyama et al. | |

FOREIGN PATENT DOCUMENTS

| | | | |
|---|---|---|---|
| CN | 101000750 | A | 7/2008 |
| DE | 1132005052140 | A1 | 12/2007 |
| KR | 20070074845 | A | 7/2007 |
| KR | 20070121134 | A | 12/2007 |
| WO | 2011/007464 | A1 | 1/2011 |

OTHER PUBLICATIONS

Extended European Search Report for European Application No. 12839166.1, mailed on Mar. 27, 2015, 7 pages total.

First Office Action issued on Mar. 31, 2014 in Korean Application No. 10-2013-7011977, 4 pages (English translation, 5 pages).

Search Report as received in corresponding European Patent Application No. 12839166.1, dated Jan. 25, 2016.

* cited by examiner

GATE DRIVING CIRCUIT OF DISPLAY PANEL AND DISPLAY SCREEN WITH THE SAME

CROSS-REFERENCES TO RELATED APPLICATIONS

This application claims priority to and is a continuation of International Patent Application PCT/CN2012/078236, titled "GATE DRIVING CIRCUIT OF DISPLAY PANEL AND DISPLAY SCREEN WITH THE SAME", filed on Jul. 5, 2012, which claims priority to Chinese patent application No. 201110373342.4, entitled "GATE DRIVING CIRCUIT OF DISPLAY PANEL AND DISPLAY SCREEN WITH THE SAME" and filed with the State Intellectual Property Office on Nov. 22, 2011, the contents of which are incorporated herein by reference in their entirety.

FIELD OF THE INVENTION

The invention relates generally to the technical field of a Liquid Crystal Display (LCD) device, and in particular to a gate driving circuit of a display panel and a display screen with the same.

BACKGROUND OF THE INVENTION

With development of the LCD display, traditional gate wiring makes it difficult to meet a requirement of an increasingly higher screen resolution. A Gate-In-Panel (GIP) technique has been widely used in industry.

FIG. 1 shows a gate wiring scheme of a GIP circuit in the related art, in which repeated units (i.e., units shown in figure, such as Un, Un+1, Un+2, Un+3, and so on) and peripheral wires can be used by the GIP circuit. In this way, space of the periphery can be saved, and a lighter and thinner screen can be developed.

However, addressing-driving for the GIP circuit is difficult since some peripheral wires have been omitted from the structure of the GIP circuit. It is difficult to manufacture an addressing circuit with good performance, especially in an Amorphous Silicon Gate (ASG) circuit.

Due to poor data retention, the ordinary LCD must be refreshed continuously for the entire screen to maintain the display, and thus there is no demand to perform the addressing and refreshing on only a certain region. However, with the development of bistable technology, a demand for the addressing-driving is increasing for certain applications, such as an electronic book (Ebook), a Memory In Pixel, etc. By refreshing a certain area of the screen, the power consumption can be reduced and the refreshing rate can be improved.

In the related art, in most addressing schemes, a selective signal output can be achieved by decoding the address lines, as shown in FIG. 2. The addressing circuit is in fact a decoder. That is to say, the decoder outputs a gate signal through each of the address lines with an independent value of 0 or 1, and only one output transmitting the Gate signal is selected.

Therefore, in the related art, in order to address the gate lines, it is required to increase a wiring space of the address lines with a bulky decoding circuit. Taking the ordinary WVGA as an example, additional 10 address lines are required for the addressing of 800 gate lines, and at least 10 PMOS or NMOS transistors are required to perform a gating for each gate line. Furthermore, there is no suitable implementation scheme in the related art for the amorphous silicon material to achieve such a decoding circuit. An ASG circuit, i.e. an ordinary amorphous silicon circuit, is not suitable to be a PMOS transistor, and has a poor circuit performance. Therefore, it is very difficult to achieve space-efficient decoding using amorphous silicon technology.

BRIEF SUMMARY OF THE INVENTION

One implementation is a gate driving circuit of a display panel. The gate driving circuit is adapted to drive a plurality of gate lines arranged in the display panel. The gate driving circuit of the display panel includes a shift register including at least two stages of shift register units, and a gate enable circuit. Each shift register unit includes a gate signal output terminal configured to output a gate signal. The gate enable circuit includes a plurality of gate enable units. Each gate enable unit corresponds to one of the shift register units, and each gate enable unit includes an input terminal connected to the gate signal output terminal of the corresponding shift register unit, an output terminal connected to a corresponding one of the gate lines, and an enable signal input terminal configured to receive an enable signal. Each gate enable unit is configured to selectively output the gate signal of the corresponding shift register unit to the corresponding gate line based on a state of the received enable signal.

Another implementation is a display screen including a display panel having a plurality of gate lines, and a gate driving circuit configured to drive the gate lines of the display panel. The gate driving circuit of the display panel includes a shift register including at least two stages of shift register units, and a gate enable circuit. Each shift register unit includes a gate signal output terminal configured to output a gate signal. The gate enable circuit includes a plurality of gate enable units. Each gate enable unit corresponds to one of the shift register units, and each gate enable unit includes an input terminal connected to the gate signal output terminal of the corresponding shift register unit, an output terminal connected to a corresponding one of the gate lines, and an enable signal input terminal configured to receive an enable signal. Each gate enable unit is configured to selectively output the gate signal of the corresponding shift register unit to the corresponding gate line based on a state of the received enable signal.

DETAILED DESCRIPTION OF THE INVENTION

An embodiment provides a gate driving circuit of a display panel and a display screen which are adapted to address a gate signal more easily, for example, so as to avoid redundancy in a decoding circuit, occupy a smaller circuit area, save cost, and improve addressing speed.

In the embodiment, additional gate addressing is achieved by adding GIP peripheral circuits. Therefore, the embodiment is not limited at a specific GIP circuit or GIP circuit structure.

The technical solution provided by the embodiment is illustrated hereinafter with reference to accompanying drawings.

Figure 1:
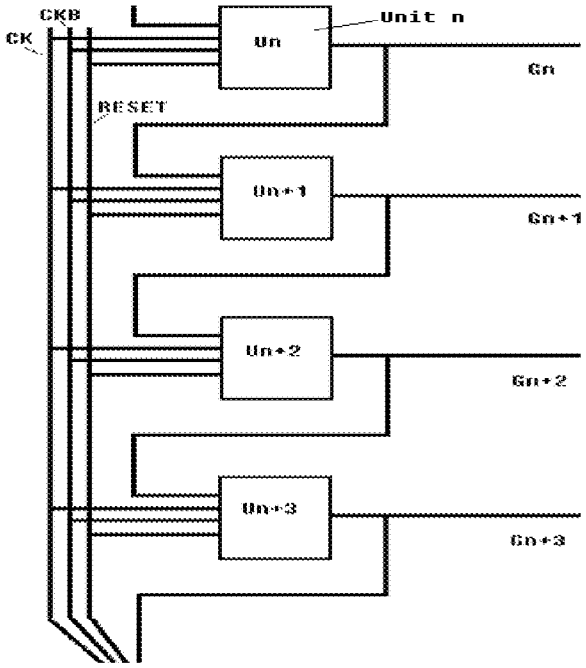
FIG. 1 is a structural schematic diagram of a GIP circuit, as known in the related art.
Figure 2:
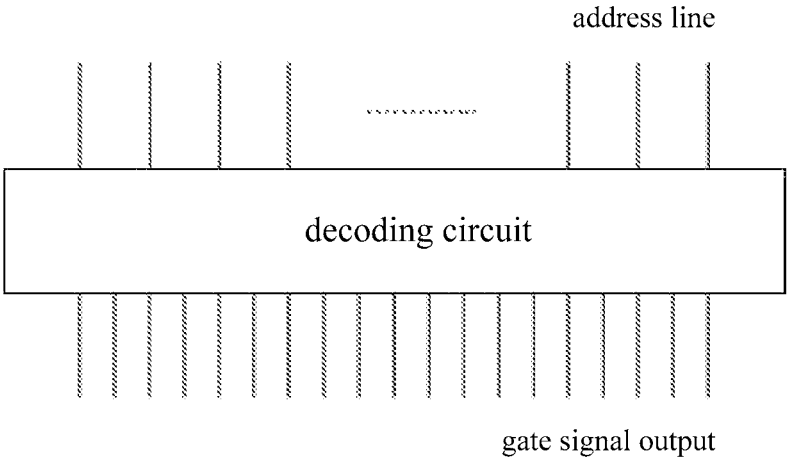
FIG. 2 is a structural schematic diagram of an addressing circuit, as known in the related art.
Figure 3:
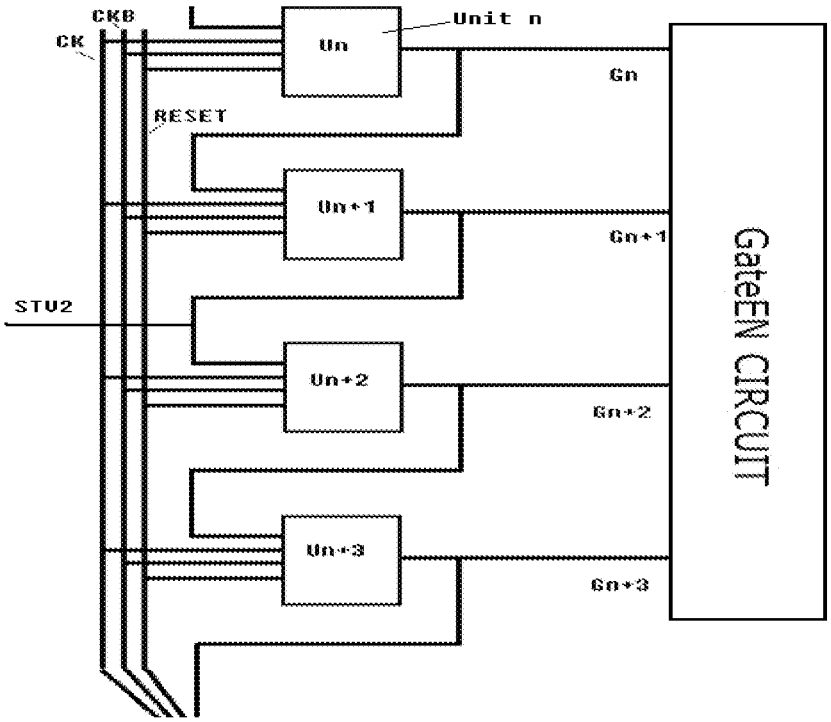
FIG. 3 is a structural schematic diagram of a GIP circuit according to an embodiment of the invention.

As shown in FIG. 3 which shows a gate driving circuit of a display panel adapted to drive gate lines arranged in a display panel according to an embodiment. The gate driving circuit of the display panel includes: a shift register and gate enable units, in which the shift register includes cascaded shift register units. In the embodiment shown in FIG. 3, each of the shift register units Un, Un+1, Un+2, Un+3, and so on, is connected with a corresponding gate enable unit, and all the gate enable units form a Gate EN CIRCUIT (a gate enable circuit) shown in FIG. 3.

Figure 4:
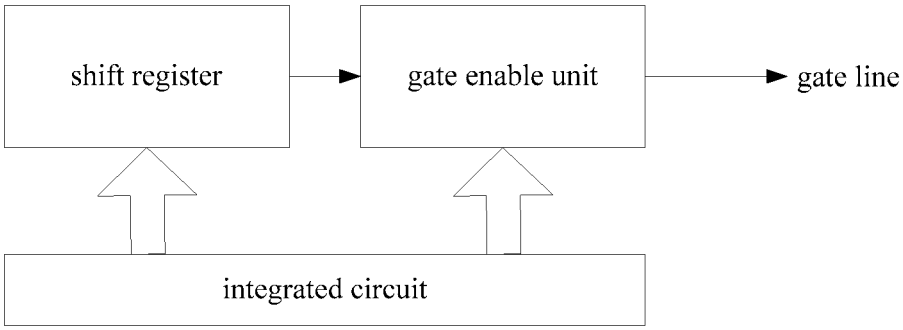
FIG. 4 is a structural schematic diagram of a GIP circuit according to an embodiment of the invention.

The shift register includes at least two cascaded shift register units. Referring to FIG. 4, a gate signal output terminal of each shift register unit is connected with an input terminal of a corresponding gate enable unit, and an output terminal of the gate enable unit is connected with a gate line. The gate enable unit also has an enable signal input terminal. The gate enable unit transfers the gate signal output from the gate signal output terminal of the shift register unit to the gate line according to an enable signal received on the enable signal input terminal.

As shown in FIG. 4, the gate driving circuit of the display panel may include, for example, an integrated circuit IC for providing the enable signal to the gate enable unit.

Figure 5:
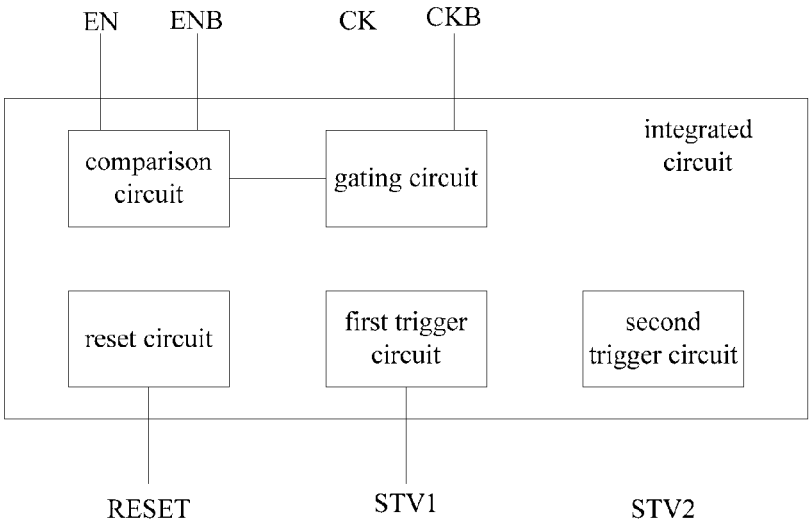
FIG. 5 is a structural schematic diagram of an integrated circuit according to an embodiment of the invention.

As shown in FIG. 5, the integrated circuit IC includes a comparison circuit adapted to compare image information of all the pixel points in the same row of adjacent frames of images to be displayed on the display panel, and outputs the comparison result as the enable signal to the enable signal input terminal of the gate enable unit.

If image information of all pixel points in the same row of the adjacent frames are the same, the gate signal from the gate signal output terminal of the shift register unit is not transferred to the gate line according to the enable signal, such that the image data of this row is not refreshed. If the image information of at least one pixel point in the same row of the adjacent frames of the image is different, the gate signal from the gate signal output terminal of the shift register unit is transferred to the gate line according to the enable signal, and the image data of the row is refreshed.

As shown in FIG. 5, the integrated circuit IC further includes: a gating circuit for supplying a clock signal to each stage of shift register unit, a reset circuit for supplying a reset signal (RESET) to each stage of shift register units, and a first trigger circuit for supplying a first trigger signal (STV1) to a first stage of shift register unit. The first trigger signal is used to trigger an operation of the first stage of shift register unit.

The gating circuit supplies different clock signals to respective stages of the shift register units according to the comparison result of the comparison circuit.

In addition, in FIG. 5, each stage of the shift register units has a reset signal (RESET), which is only a specific embodiment and does not limit the invention. For example, one stage of the shift register can be reset by the output of the next stage of the shift register. There are both CK and CKB in FIG. 5, which is also only a specific embodiment and does not limit the invention. For example, CK and CKB can appear singly.

Figure 6:
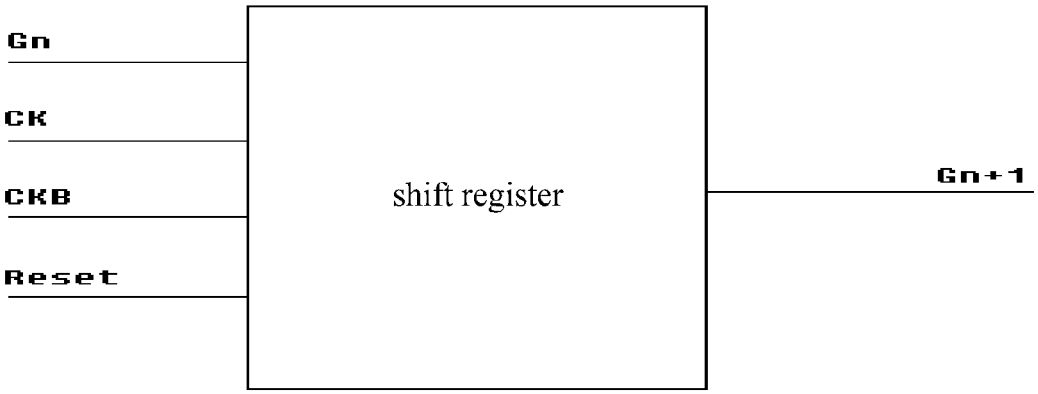
FIG. 6 is a schematic diagram of a shift register unit in the GIP circuit according to an embodiment of the invention.

Taking the $(N+1)^{th}$ stage of shift register unit as an example, as shown in FIG. 6, a signal Gn received from the $n^{th}$ stage of shift register unit triggers the operation of the $(n+1)^{th}$ stage of shift register unit. CK and CKB are the clock signals, RESET is the reset signal, and CK, CKB and RESET are all supplied from the integrated circuit IC. The signal output from the $(n+1)^{th}$ stage of shift register unit is Gn+1 for triggering the operation of the $(n+2)^{th}$ stage of shift register unit. The signal is also transferred to corresponding scanning lines as required.

The first stage of shift register unit is triggered by the first trigger signal STV1 supplied from the integrated circuit IC.

In some embodiments, if the image information of all the pixel points in the same row of the adjacent frames of the image are the same, the gating circuit supplies a first clock signal (CK1, CKB1) to each of the stages of shift register units. If the image information of the at least one pixel point in same row of adjacent frames of the image is different, the gating circuit supplies a second clock signal (CK2, CKB2) to each of the stages of shift register units. The frequency of the first clock signal is higher than that of the second clock signal, i.e. the frequency of CK1 is higher than that of CK2, and the frequency of CKB1 is higher than that of CKB2.

Figure 7:
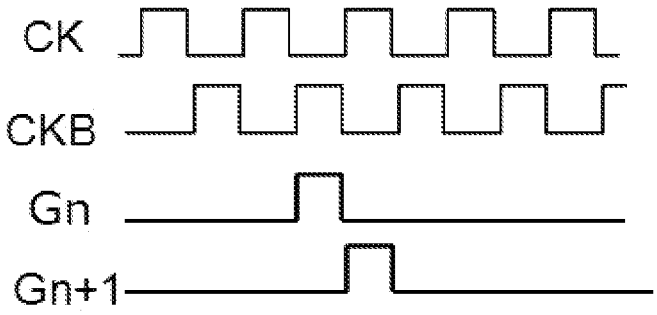
FIG. 7 is a schematic diagram illustrating timing waveforms that is transported by the GIP circuit according to an embodiment of the invention.

A principle of the GIP circuit is that a waveform signal generated by the Integrated Circuit (IC) is transferred by using logic signal lines, and then gate signals are generated in the shift register units (also referred to as repeatable unit) and output, so as to perform the triggering stage-by-stage. As shown in FIG. 7, the gate signal Gn generated by the $n^{th}$ shift register unit triggers the $(n+1)^{th}$ stage of shift register unit, such that the $(n+1)^{th}$ stage of shift register unit generates a gate signal Gn+1. In general, there are two factors affecting the scanning speed of the gate: the speed of the device, and the frequency of the control signal.

Therefore, in some embodiments, the scanning speed of the gate can be changed within the allowable range of the device by changing the frequency of the clock signal, where the clock signal refers to input signals with various waveforms in a broad sense, such as the clock signals CK or CKB show in FIG. 7, which is not limited to a clock signal in a narrow sense.

Figure 8:
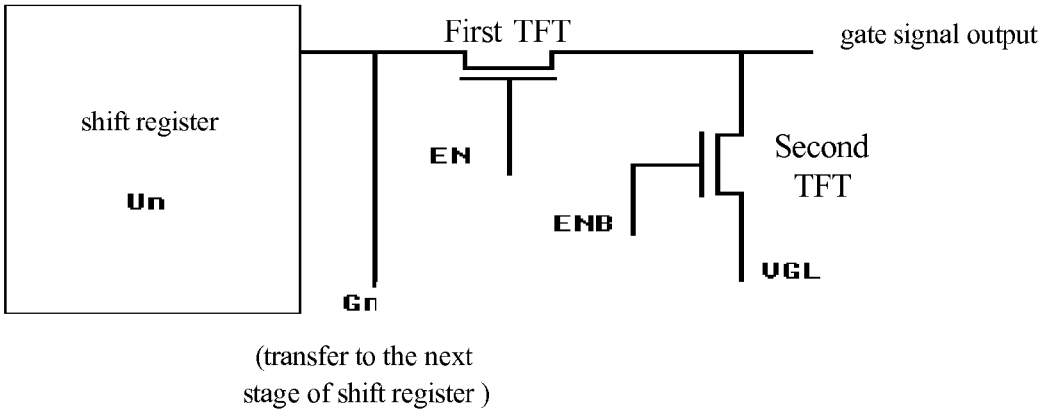
FIG. 8 is a structural schematic diagram of the device including a shift register unit and a gate enable unit according to a first embodiment of the invention.

As shown in FIG. 8, the gate enable unit connected with each shift register unit includes two N-type thin film field effect transistors (TFTs).

The gate signal output terminal of the shift register unit is connected with the source of a first TFT, the drain of the first TFT is connected with the source of a second TFT and is used as an output terminal of the gate enable unit. The gate of the first TFT is supplied with an enable signal EN from the integrated circuit IC, the gate of the second TFT is supplied with an inverted enable signal ENB from the integrated circuit IC, and the drain of the second TFT is supplied with a gate low-level voltage signal VGL from the integrated circuit IC.

In the case that the enable signal EN from the integrated circuit IC to the gate of the first TFT gate is a high level signal and the inverted enable signal ENB from the integrated circuit IC to the gate of the second TFT is a low level signal, the first TFT is on and the second TFT is off. In response, the drain of the first TFT outputs a gate signal from the output terminal of the gate enable unit.

In the case that the enable signal EN from the integrated circuit IC to the gate of the first TFT is the low level signal and the inverted enable signal ENB from the integrated circuit IC to the gate of the second TFT is the high level signal, the first TFT is off and the second TFT is on. In response, the integrated circuit IC outputs to the drain of the second TFT a VGL signal from the output terminal of the gate enable unit.

Control principle of EN and ENB is as follows.

The EN and ENB supplied from the IC may be ordinary digital signals. When the EN is high and the ENB is low, the TFT controlled by EN is on and the TFT controlled by ENB is off, and there is an output on the gate line. When the EN is low and the ENB is high, the TFT controlled by EN is off and the TFT controlled by ENB is on, so that the gate line is at VGL (Gate has low-level voltage), i.e. there is no output on the gate line.

In some embodiments, by raising the frequency of the clock signal, the image region that needs not to be scanned can be skipped over at a faster speed based on the enable signal inputted to the gate enable units. In addition, by reducing the frequency of the clock signal, the specified region of the image is scanned based on the enable signal to the gate enable unit, thus achieving addressing-scanning.

Figure 9:
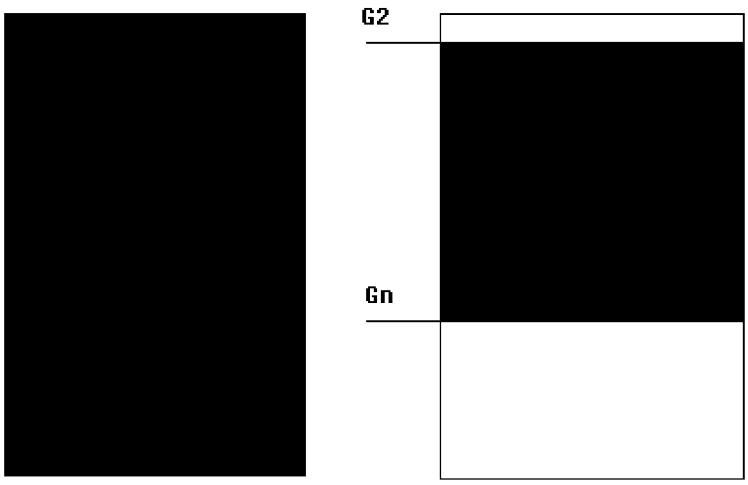
FIG. 9 is a schematic diagram illustrating a determination of a non-scan region according to an embodiment of the invention.

As shown in FIG. 9, before the process of refreshing the display, two images (i.e. the currently displayed image and the refreshing image) can be compared to obtain the number of rows of the image region which needs to be skipped over, that is, the rows G3 to Gn−1 are the non-scan region of the image.

Figure 10:
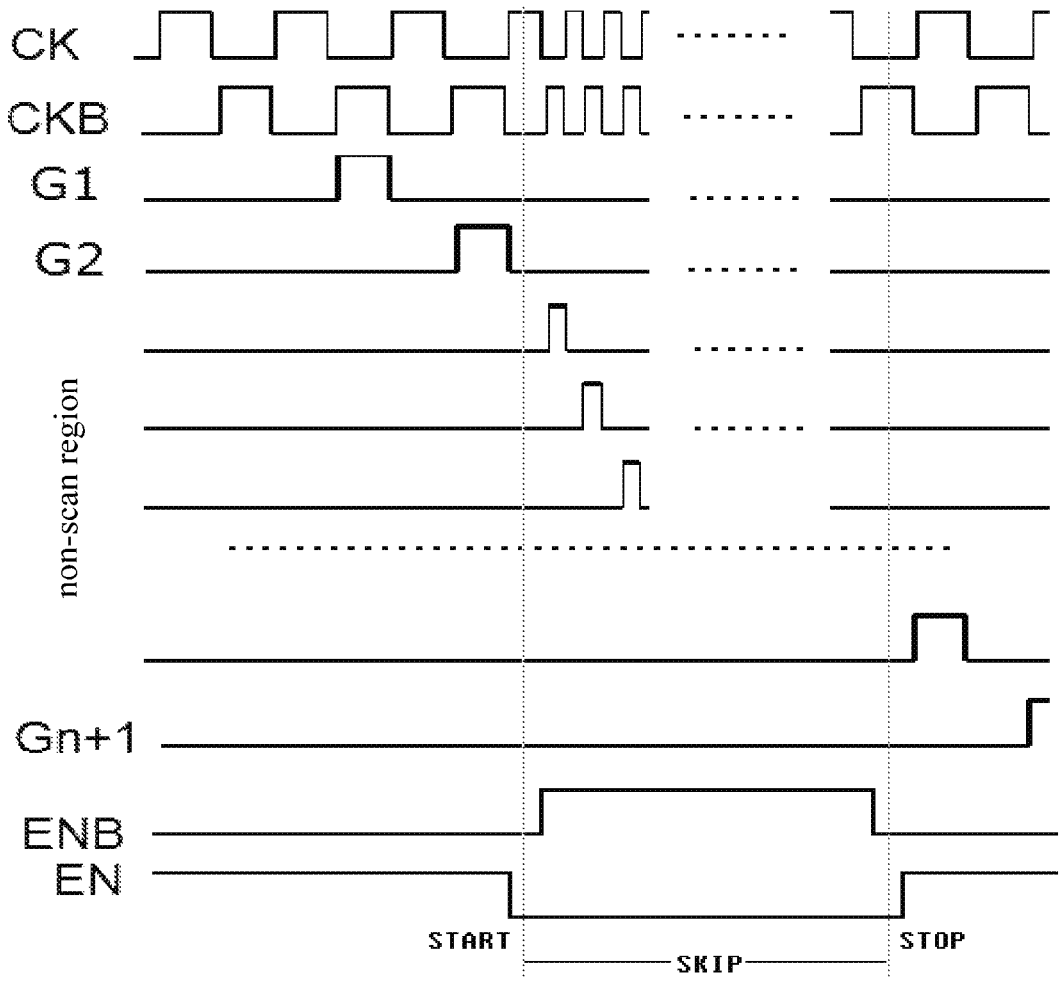
FIG. 10 is a schematic diagram illustrating a clock signal and enable signal with different frequencies when a GIP circuit according to an embodiment of the invention performs a gate signal addressing.

Referring to FIG. 10, during the scan of the rows G1 and G2, the frequencies of the clock signals CK and CKB are low, so that the new image data of rows G1 and G2 is displayed. After the scan of the G2 and before the scan of the image region which needs to be scanned and displayed, the frequency of CK and CKB is raised, the enable signal EN is set to low and the enable signal ENB is set to high, such that the gate lines are scanned quickly (SKIP process in figure). In the SKIP process, there is no output on the gate lines due to the EN signal and the ENB signal. When the process proceeds to a specified scan position of the image, such as the $n^{th}$ row, the frequencies of the CK and CKB signals are recovered, and the enable signal EN is set to high, the enable signal ENB is set to low, thus refreshing the specified region of image.

Figure 11:
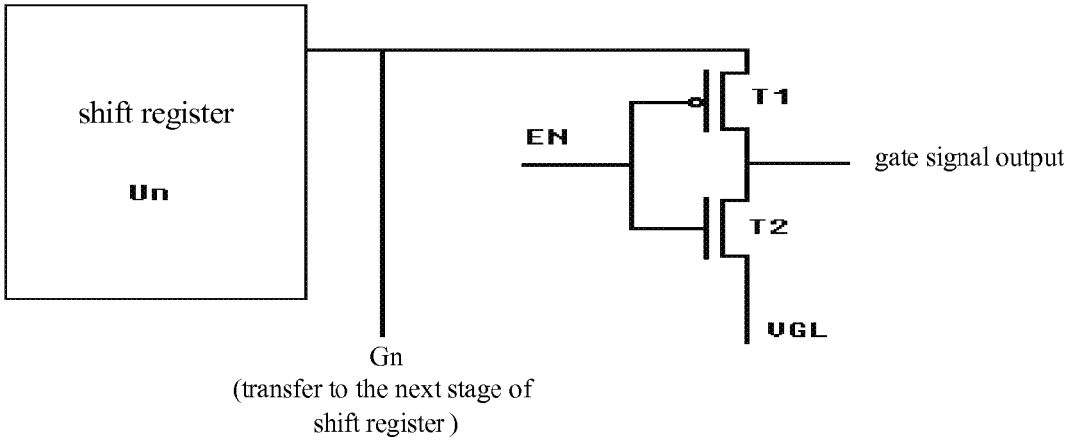
FIG. 11 is a structural schematic diagram of a shift register unit and a gate enable unit according to a second embodiment of the invention.

The structure of the gate enable unit above may be used for an amorphous silicon thin film field effect transistor (a-Si TFT). Another structure can be used for a Low-Temperature Poly-Silicon Thin film Field effect Transistor (LTPS-TFT). As shown in FIG. 11, since the LTPS can use a P-type thin film field effect transistor TFT with a good performance. Accordingly, the signals EN and ENB can be combined into a uniform enable signal EN. The P-type thin film field effect transistor TFT (i.e. T1 shown in FIG. 11) and the N-type thin film field effect transistor TFT (i.e. T2 shown in FIG. 11) form a common CMOS structure. The operation principle is as follows: when EN is low, T1 is on and T2 is off, the gate signal Gn output by the shift register unit Un is output to the Gate line via T1. Conversely, if EN is high, T1 is off and T2 is on, and the gate line will be at the VGL signal via T2, i.e. there is no output on the gate line. It can be seen from FIG. 11 that there is no effect on the signal transfer of Gn to the next stage of shift register unit when the Gate line is locked at the VGL level. Therefore, the gate enable unit connected with each shift register unit includes a P-type thin film field effect transistor TFT and an N-type thin film field effect transistor TFT, of which, the source of the P-type thin film field effect transistor TFT is connected with the gate signal output terminal of the shift register unit. The drain of the P-type thin film field effect transistor TFT is connected with the drain of the N-type thin film field effect transistor TFT and is used as the output terminal of the gate enable unit. The gate of the P-type thin film field effect transistor TFT and the gate of the N-type thin film field effect transistor TFT are both supplied with an enable signal EN from the integrated circuit IC, and the source of the N-type thin film field effect transistor TFT is supplied with a gate low-level voltage signal VGL from the integrated circuit IC.

When the enable signal EN from the integrated circuit IC to the gates of the P-type thin film field effect transistor TFT and the N-type thin film field effect transistor TFT is a low level signal, the P-type thin film field effect transistor TFT is on, the N-type thin film field effect transistor TFT is off, and the drain of the P-type thin film field effect transistor TFT outputs a gate signal which is outputted from the output terminal of the gate enable unit.

When the enable signal EN outputted from the integrated circuit IC to the gates of the P-type thin film field effect transistor TFT and the N-type thin film field effect transistor TFT is a high level signal, the N-type thin film field effect transistor TFT is on, the P-type thin film field effect transistor TFT is off, and the integrated circuit IC outputs to the drain of the N-type thin film field effect transistor TFT the VGL signal from the output terminal of the gate enable unit.

Furthermore, considering the speed limitation of the amorphous silicon TFT, in order to achieve faster addressing, an initial trigger signal can be led out from a shift register unit. As shown in FIG. 3, an initial signal STV2 is led out between Un+1 and Un+2. If an initial address line of a certain initialized region is greater than N+1, instead of the gate signal outputted from a previous stage of shift register unit, the STV2 can be input directly to trigger the GIP. In this way, the scanning time can be reduced greatly. In general, the average addressing time can be reduced to 1/N by additionally adding N trigger signal STV2 lines. However, the occupied area of trigger signal lines also increases. Therefore, it is advantageous to balance the speed and the occupied area when the specific solution is designed.

For example, in the case that the resolution of the display is 800 (Gate)*480, if the trigger signal STV2 of the $401^{th}$ stage of shift register unit is led out, the longest time for performing the fast scanning is 400T, where T is the average scan time occupied by each gate line during the fast scanning.

Therefore, as shown in FIG. 5, the integrated circuit IC further includes a second trigger circuit for supplying a second trigger signal (STV2) to the selected shift register unit, where the second trigger signal is adapted to trigger the operation of the selected shift register unit.

The principles of the comparison circuit and the gating circuit in the integrated circuit provided by the embodiment are discussed hereinafter.

Figure 12:
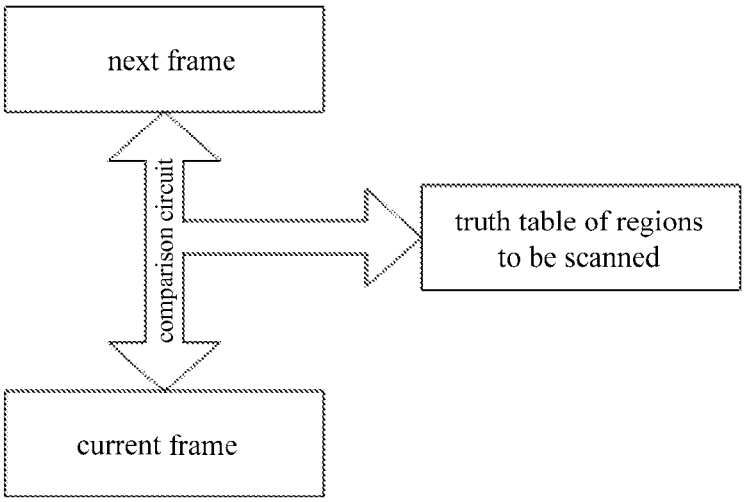
FIG. 12 is a structural schematic diagram of a comparison circuit according to an embodiment of the invention.

Referring to FIG. 12, the comparison circuit in the integrated circuit provided by the embodiment includes a next frame unit, a current frame unit and a truth table unit of regions to be scanned.

When a picture is displayed, the comparison circuit stores the displaying picture and a next picture to be displayed in the current frame unit and the next frame unit shown in FIG. 12, respectively. Then, the two pictures are compared in a display interval between the current row and the next row, and the comparison result in the region to be scanned is stored in a memory (typically registers) in a binary form, i.e. the truth table unit of regions to be scanned, as shown in FIG. 12.

The next frame unit, the current frame unit and the truth table unit of regions to be scanned are memories. The capacities of the current frame unit and the next frame unit are the same; and the picture sizes saved into the current frame unit and the next frame unit are also the same. The size of the truth table unit of regions to be scanned is related to the number of the gates. If the number of the gates is 800, the truth table unit of regions to be scanned can be set to be 800*1 registers, i.e. 800 1-bit registers.

The comparison circuit can be described in Verilog language. When data of every row to be scanned in the current frame and the next frame are provided to the comparison circuit, the comparison circuit outputs a data stream of 0's and 1's which is stored in the truth table unit of regions to be scanned.

Figure 13:
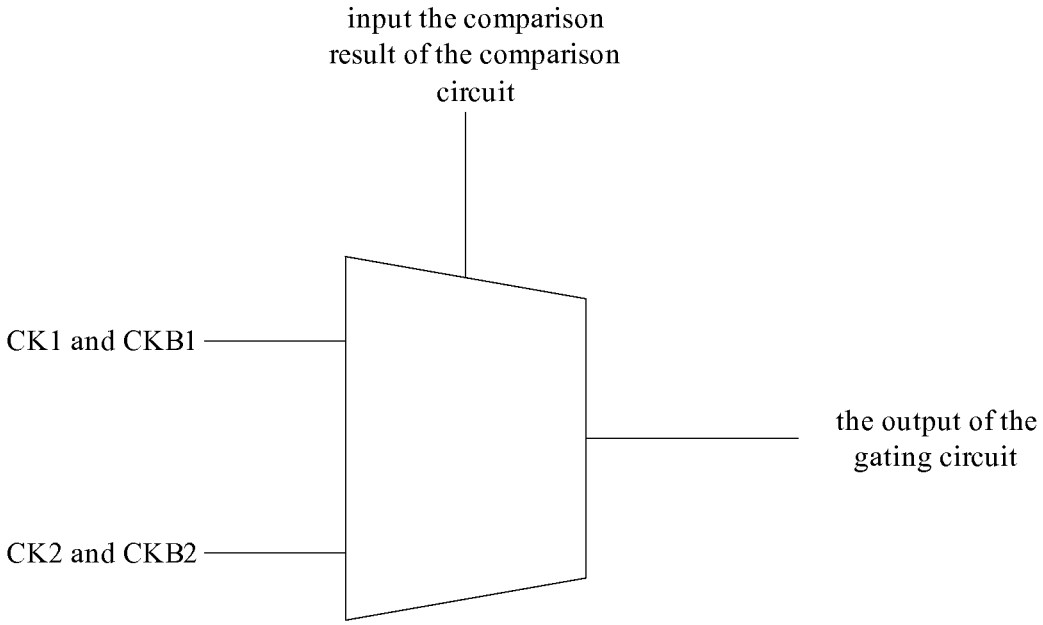
FIG. 13 is a structural schematic diagram of a gating circuit according to an embodiment of the invention.

The gating circuit in the integrated circuit provided by an embodiment includes, for example, a 2 to 1 multiplexer, as shown in FIG. 13. The circuit characteristics of the multiplexer can also be described in Verilog language. The value saved in the truth table unit to be scanned in the comparison circuit (i.e. comparison result of the comparison circuit) can be input to the gating circuit at the rising edge of each clock signal to be output, and then the clock signal from the output terminal of the gating circuit can be switched between (CK1, CKB1) and (CK2, CKB2). In this way, the frequency of the outputted clock signal can be adjusted, and a variable frequency driving can be achieved by applying the clock signal into the GIP circuit.

Finally, an embodiment provides a display screen which includes the gate driving circuit of the display panel described above.

In summary, with the gate driving circuit of the display panel provided by the described embodiments, the GIP addressing of the variable frequency driving can be achieved by adding a few of address lines and control lines. An initial trigger signal line may be added in the GIP structure, so as to improve the addressing speed. Moreover, there is no need to implement the decoding on the panel in the addressing solution. That is, there is no need to add a decoding circuit, thus omitting the decoding circuit, occupying a smaller area. This solution is particularly advantageous in implementations using amorphous silicon material. The technical solution provided by the embodiment of the invention may also be applicable to various display screens with a gate addressing circuit.

Those skilled in the art should understand that implementations can be embodied as a method, a system or a computer program product. Accordingly, embodiments can be implemented by hardware, software, or virtually any combination thereof. Moreover, embodiments can be implemented by a computer program product which is implemented on one or more computer usable storage media (including but not limited to a disk storage, an optical memory, etc.) saving the computer usable program code.

Various aspects are described with reference to the method, apparatus (system) and the flowchart and/or block diagram of a computer program product according to certain embodiments. It should be understood that each flow and/or block of the flowcharts and/or block diagrams or a combination thereof can be achieved by computer program instructions. These computer program instructions can be provided to a general purpose computer, a special purpose computer, an embedded processor or other programmable data processing apparatus to produce a machine, so that a device for implementing one or more flows in the flowcharts and/or functions specified by one or more blocks in the block diagrams can be produced with the instructions executed by the computer or other programmable data processing apparatus.

These computer program instructions can also be stored in a computer-readable memory that can guide a computer or other programmable data processing apparatus to operate in a specific manner, so that the instructions stored in the computer readable memory generate manufactured articles including the instruction device which implements one or more flows in the flowcharts and/or the functions specified by one or more blocks in the block diagrams.

These computer program instructions can also be loaded to a computer or other programmable data processing apparatus, so that a series of operation steps are executed on the computer or other programmable apparatus to generate the computer-implemented processing, thus enabling the instructions executed on the computer or other programmable apparatus to provide steps for implementing one or more flows in the flowchart and/or functions specified by one or more blocks in the block diagrams.

Those skilled in the art can make various modifications and variations of the discussed embodiments without departing from the spirit and scope of the invention.

What is claimed is:

1. A gate driving circuit of a display panel, adapted to drive a plurality of gate lines arranged in the display panel, wherein the gate driving circuit of the display panel comprises:

a shift register comprising at least two stages of shift register units, wherein each shift register unit comprises a gate signal output terminal configured to output a gate signal; and a gate enable circuit, comprising:

a plurality of gate enable units, wherein each gate enable unit corresponds to one of the shift register units, and wherein each gate enable unit comprises:

an input terminal connected to the gate signal output terminal of the corresponding shift register unit, an output terminal connected to a corresponding one of the gate lines, and an enable signal input terminal configured to receive an enable signal, wherein each gate enable unit is configured to selectively output the gate signal of the corresponding shift register unit to the corresponding gate line based on a state of the received enable signal;

wherein the gate driving circuit of the display panel further comprises an integrated circuit adapted to supply the enable signal to the gate enable units; the integrated circuit comprises a comparison circuit configured to compare a row of image data of each frame with the image data of the same row in an adjacent frame, and to generate the enable signal based on the comparison result.

2. The gate driving circuit of the display panel according to claim 1, wherein in the case that the image data of a row of a frame is the same as the image data of the same row in an adjacent frame, the enable signal generated by the comparison circuit causes the gate enable unit receiving the enable signal to not output the gate signal of the corresponding shift register unit to the corresponding gate line, and wherein in the case that the image data of a row of a frame is different from the image data of the same row in an adjacent frame, the enable signal generated by the comparison circuit causes the gate enable unit receiving the enable signal to output the gate signal of the corresponding shift register unit to the corresponding gate line.

3. The gate driving circuit of the display panel according to claim 2, wherein the integrated circuit further comprises:

a gating circuit adapted to supply a clock signal to each stage of the shift register units;

a reset circuit adapted to supply a reset signal to each stage of the shift register units; and a first trigger circuit adapted to supply a first trigger signal to the first stage of the shift register unit, wherein the first trigger signal is adapted to trigger an operation of the first stage of the shift register unit.

4. The gate driving circuit of the display panel according to claim 3, wherein the gating circuit supplies different clock signals to respective stages of the shift register according to the comparison result of the comparison circuit.

5. The gate driving circuit of the display panel according to claim 4, wherein in the case that the image data of a row of a frame is the same as the image data of the same row in an adjacent frame, the gating circuit supplies a first clock signal to the respective stages of the shift register, and wherein in the case that the image data of a row of a frame is different from the image data of the same row in an adjacent frame, the gating circuit supplies a second clock signal to the respective stages of the shift register, wherein a frequency of the first clock signal is higher than a frequency of the second clock signal.

6. The gate driving circuit of the display panel according to claim 3, wherein the integrated circuit further comprises a second trigger circuit for supplying a second trigger signal to a selected shift register unit, wherein the second trigger signal is adapted to trigger the operation of the selected shift register unit.

7. The gate driving circuit of the display panel according to claim 1, wherein each gate enable unit comprises two N-type thin film field effect transistors (TFTs), wherein the gate signal output terminal of the corresponding shift register unit is connected with the drain of a first TFT, the source of the first TFT is connected with the drain of a second TFT and is connected to the output terminal of the gate enable unit, and wherein the gate of the first TFT is supplied with the enable signal from the integrated circuit, the gate of the second TFT is supplied with an inverted enable signal from the integrated circuit, and the source of the second TFT is supplied with a gate low-level voltage signal from the integrated circuit.

8. The gate driving circuit of the display panel according to claim 1, wherein each gate enable unit comprises a P-type thin film field effect transistor (TFT) and an N-type TFT, wherein the source of the P-type TFT is connected with the gate signal output terminal of the shift register unit, the drain of the P-type TFT is connected with the drain of the N-type TFT and is connected to the output terminal of the gate enable unit, and wherein the gate of the P-type TFT and the gate of the N-type TFT are both supplied with an enable signal from the integrated circuit, and the source of the N-type TFT is supplied with a gate low-level voltage signal from the integrated circuit.

9. A display screen comprising:

a display panel comprising a plurality of gate lines; and a gate driving circuit configured to drive the gate lines of the display panel, wherein the gate driving circuit of the display panel comprises:

a shift register comprising at least two stages of shift register units, wherein each shift register unit comprises a gate signal output terminal configured to output a gate signal; and a gate enable circuit comprising:

a plurality of gate enable units, wherein each gate enable unit corresponds to one of the shift register units, and wherein each gate enable unit comprises:

an input terminal connected to the gate signal output terminal of the corresponding shift register unit, an output terminal connected to a corresponding one of the gate lines, and an enable signal input terminal configured to receive an enable signal, wherein each gate enable unit is configured to selectively output the gate signal of the corresponding shift register unit to the corresponding gate line based on a state of the received enable signal;

wherein the gate driving circuit further comprises an integrated circuit adapted to supply the enable signal to the gate enable units; the integrated circuit comprises a comparison circuit configured to compare a row of image data of each frame with the image data of the same row in an adjacent frame, and to generate the enable signal based on the comparison result.

10. The display screen according to claim 9, wherein in the case that the image data of a row of a frame is the same as the image data of the same row in an adjacent frame, the enable signal generated by the comparison circuit causes the gate enable unit receiving the enable signal to not output the gate signal of the corresponding shift register unit to the corresponding gate line, and wherein in the case that the image data of a row of a frame is different from the image data of the same row in an adjacent frame, the enable signal generated by the comparison circuit causes the gate enable unit receiving the enable signal to output the gate signal of the corresponding shift register unit to the corresponding gate line.

11. The display screen according to claim 10, wherein the integrated circuit further comprises:

a gating circuit adapted to supply a clock signal to each stage of the shift register units;

a reset circuit adapted to supply a reset signal to each stage of the shift register units; and a first trigger circuit adapted to supply a first trigger signal to the first stage of the shift register unit, wherein the first trigger signal is adapted to trigger an operation of the first stage of the shift register unit.

12. The display screen according to claim 11, wherein the gating circuit supplies different clock signals to respective stages of the shift register according to the comparison result of the comparison circuit.

13. The display screen according to claim 12, wherein in the case that the image data of a row of a frame is the same as the image data of the same row in an adjacent frame, the gating circuit supplies a first clock signal to the respective stages of the shift register, and wherein in the case that the image data of a row of a frame is different from the image data of the same row in an adjacent frame, the gating circuit supplies a second clock signal to the respective stages of the shift register, wherein a frequency of the first clock signal is higher than a frequency of the second clock signal.

14. The display screen according to claim 11, wherein the integrated circuit further comprises a second trigger circuit for supplying a second trigger signal to a selected shift register unit, wherein the second trigger signal is adapted to trigger the operation of the selected shift register unit.

15. The display screen according to claim 9, wherein each gate enable unit comprises two N-type thin film field effect transistors (TFTs), wherein the gate signal output terminal of the corresponding shift register unit is connected with the drain of a first TFT, the source of the first TFT is connected with the drain of a second TFT and is connected to the output terminal of the gate enable unit, and wherein the gate of the first TFT is supplied with the enable signal from the integrated circuit, the gate of the second TFT is supplied with an inverted enable signal from the integrated circuit, and the source of the second TFT is supplied with a gate low-level voltage signal from the integrated circuit.

16. The display screen according to claim 9, wherein each gate enable unit comprises a P-type thin film field effect transistor (TFT) and an N-type TFT, wherein the source of the P-type TFT is connected with the gate signal output terminal of the shift register unit, the drain of the P-type TFT is connected with the drain of the N-type TFT and is connected to the output terminal of the gate enable unit, and wherein the gate of the P-type TFT and the gate of the N-type TFT are both supplied with an enable signal from the integrated circuit, and the source of the N-type TFT is supplied with a gate low-level voltage signal from the integrated circuit.

* * * * *